US006644500B2

(12) United States Patent
De Angelis et al.

(10) Patent No.: US 6,644,500 B2
(45) Date of Patent: Nov. 11, 2003

(54) BLOCK OF INTERLEAVED LAMINAR PRODUCTS, A PACKAGE THEREFOR AND A PROCESS FOR REALIZING SAME

(75) Inventors: Tonino De Angelis, Pescara (IT); Davide Sepe, Afragola (IT); Alessandro D'Andrea, Pescara (IT)

(73) Assignee: Fameccanica.Data Spa, Chieti (IT)

( * ) Notice: Subject to any disclaimer, the term of this patent is extended or adjusted under 35 U.S.C. 154(b) by 99 days.

(21) Appl. No.: 09/794,356

(22) Filed: Feb. 28, 2001

(65) Prior Publication Data

US 2001/0020625 A1 Sep. 13, 2001

(30) Foreign Application Priority Data

Mar. 7, 2000 (EP) ..... 00830173

(51) Int. Cl.[7] ..... B65H 1/00; A47K 10/24

(52) U.S. Cl. ..... 221/48; 221/49; 221/35; 221/46; 221/38

(58) Field of Search ..... 221/48, 49, 35, 221/46, 38

(56) References Cited

U.S. PATENT DOCUMENTS

| | | | | | |
|---|---|---|---|---|---|
| 1,767,859 | A | * | 6/1930 | Shaffer | 221/48 |
| 3,043,472 | A | * | 7/1962 | Nemoede | |
| 3,119,516 | A | | 1/1964 | Donovan | 221/47 |
| 3,462,043 | A | | 8/1969 | Frick | 221/48 |
| 3,490,645 | A | * | 1/1970 | Glass et al. | |
| 4,478,354 | A | * | 10/1984 | Notheis | 221/34 |
| 4,811,878 | A | * | 3/1989 | Horinchi | 221/44 |
| 5,332,118 | A | * | 7/1994 | Muckenfuhs | 206/494 |
| 6,090,467 | A | * | 7/2000 | Yip | 221/48 |

FOREIGN PATENT DOCUMENTS

| | | |
|---|---|---|
| DE | 0303791 | 5/1915 |
| EP | 0365462 | 4/1990 |
| EP | 0955260 | 11/1999 |

* cited by examiner

*Primary Examiner*—Donald P. Walsh
*Assistant Examiner*—Jonathan R Miller
(74) *Attorney, Agent, or Firm*—John E. Holmes; Jeffrey J. Howell

(57) ABSTRACT

A stack of interleaved laminar products comprises a first and a second array of products, each of which has at least one branch interleaved with a corresponding branch of at least one product in the other array. The products are folded into a generally W-shaped profile comprising two outer branches and two inner branches, with the distal edges of the said outer branches projecting at least partially beyond the said inner branches, so that the said distal edges can be used for interleaving with at least one other product in the stack.

25 Claims, 1 Drawing Sheet

Figure 1:
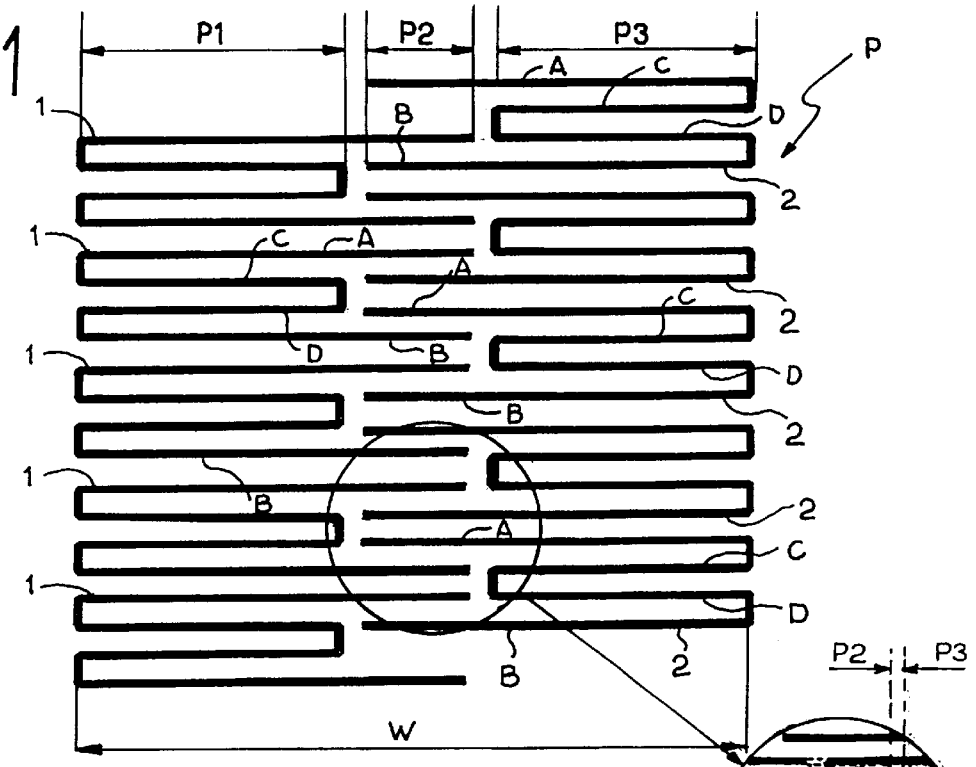

BLOCK OF INTERLEAVED LAMINAR PRODUCTS, A PACKAGE THEREFOR AND A PROCESS FOR REALIZING SAME

DESCRIPTION

The present invention relates to blocks or stacks of interleaved laminar products of the kind disclosed for example, in EP-A-0 955 260 and European Patent Application 99830650.0.

Various requirements must be met in the forming of stacks of interleaved laminar products of this type, which usually consist of personal hygiene products such as handkerchiefs, napkins, including pre-moistened products (known as "wet wipes" or "moist tissues"), toilet paper, etc.

In the first place, it is important to ensure that the interlacing (interleaving) relationship between the products in the stack is such that the correct execution of the operation of withdrawing the individual products from the stack is ensured. In particular, it is necessary to ensure that the movement of the withdrawal of a product (particularly through a slot or hole in the box or envelope used as the package for the stack) causes the automatic and correct preparation of the immediately following product for withdrawal. The whole procedure must prevent the following product from being at least partially withdrawn from the package in an undesired way.

In this connection it must be borne in mind that the determination of the interleaving relationship between successive products in the stack is subject to various factors such as:

- the characteristics of the material from which the products are made (paper, textile or non-woven materials, etc.),
- the possible presence of agents for pre-moistening the products, and, in the latter case,
- the specific characteristics (degree of adhesiveness/slip, etc.) of the substances used as agents for impregnating the material which is to be pre-moistened.

Furthermore, it is necessary to bear in mind other factors such as the requirement to minimize the surface of the product which remains exposed at the end of the stack facing the exterior, in other words at the end facing the withdrawal aperture: the portion of product exposed to the exterior can, in the case of pre-moistened products, lose at least some of its pre-moistening characteristics over a period of time, and, even in the case of non-pre-moistened products, becomes exposed, to a certain extent at least, to phenomena of contamination by external agents.

Certain interleaving methods proposed in the prior art are also subject to a drawback due to the fact that the stack of interleaved products has a different number of overlapping layers in different parts of its cross-sectional profile. The stack can thus finally assume a shape different from the right-angled parallelepiped which is usually preferred, taking on a swollen configuration at one or both of its sides or in its central portion. The described phenomenon is not essentially different from the phenomenon generally known as "rising" which occurs during the stacking of signatures in the printing industry, where, however, the phenomenon is essentially due to the presence of the spine folds of the signatures, rather than to the different number of overlapping layers.

Other factors to be borne in mind may be mentioned, such as the requirement to ensure that the interleaving process can be implemented simply and efficiently, without undesired complications, and the fact that the stack of interleaved products should preferably be symmetrical, and thus be such that it does not have a preferred direction of orientation for the purposes of insertion into a package, particularly when the package is to be provided with an aperture or slot for withdrawal of the products.

It is also important to ensure that the part of each product designed to act as the pick-up flap for the product is located in a central position, or in any case in a specified position. In this connection, there are documents such as U.S. Pat. No. 3,401,927, relating to special folding solutions intended to ensure that the pick-up flap of the first product is positioned next to the pick-up slot of the package.

The object of the present invention is to provide a solution capable of meeting the requirements expressed above while also avoiding the drawbacks described previously.

According to the present invention, this object is achieved by means of a stack of interleaved products having the characteristics claimed in the following claims.

The invention also relates to the corresponding package and the corresponding forming process.

The solution according to the invention not only meets the aforesaid requirements and avoids the drawbacks described previously, but has further advantages such as, for example, the advantage due to the possibility of varying the interleaving relationship between the products in a selective way without causing a variation in the overall width of the stack. This characteristic is particularly advantageous since, for example, it makes it possible to use packages of identical dimensions for containing stacks of interleaved products with different characteristics. In addition to this, the solution according to the invention makes it possible to provide the desired central positioning of the pick-up flap of the products.

Figure 2:
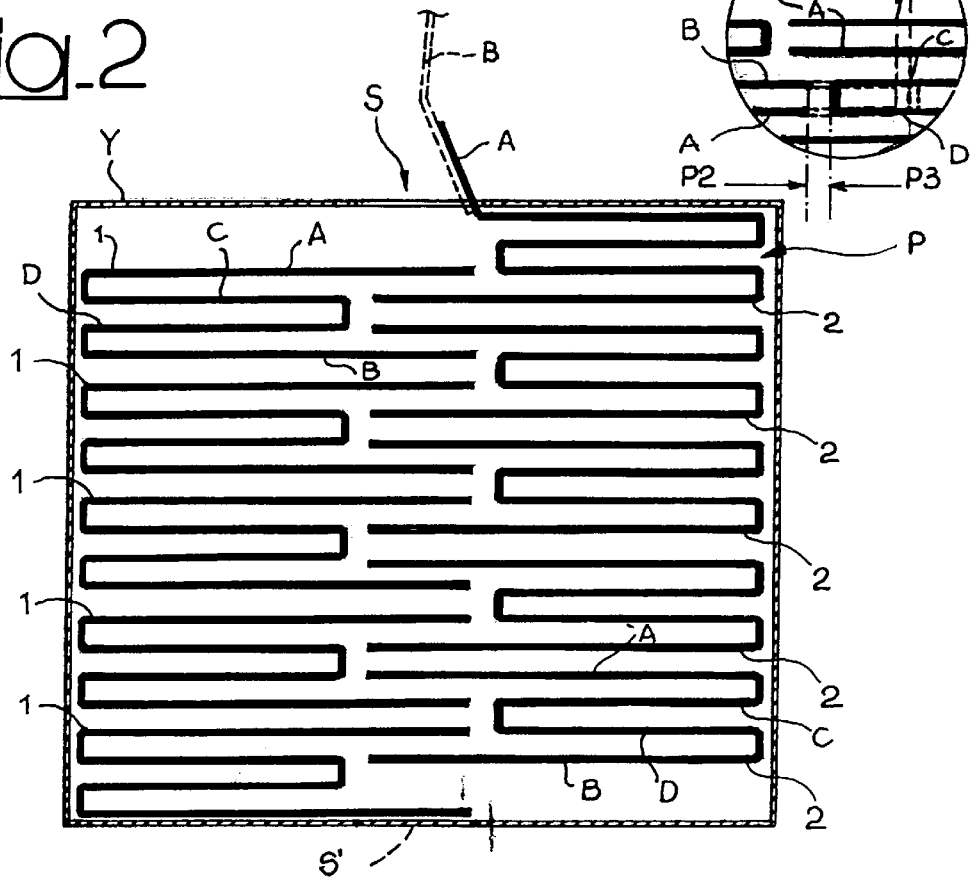

The invention will now be described, purely by way of example and without restrictive intent, with reference to the attached drawings, in which:

FIG. 1 is a general cross-sectional view of a stack of interleaved products according to the invention, and FIG. 2 shows schematically the mechanism for withdrawing the products forming part of the aforesaid stack from the corresponding package.

In both FIGS. 1 and 2, the reference P indicates as a whole a stack of interleaved products 1, 2, consisting, for example, of laminar products such as handkerchiefs, napkins or similar products for cleansing or hygiene such as, for example, toilet paper, which may be pre-moistened.

In each case, the specific nature, the procedures and the purposes of the use of the products 1, 2 are not determining factors where the invention is concerned, even though—as will be made clearer subsequently—the invention has the important characteristic of being adaptable in a flexible way to the various requirements for its application.

The above is also true of the material constituting the products 1, 2, which can be made from paper-based material, non-woven textiles, textile materials, films of plastic material, etc.

Provided that they meet the requirement to have an overall laminar configuration and a corresponding degree of flexibility such that their interleaving is possible, the products 1, 2 can have any configuration: to give a further example, these products may be disposable gloves which can be used, for example, in the home, in medical environments or at points of sale.

The fact that the products included in the stack P are identified by two separate references 1, 2 indicates the fact that the products are ordered in two arrays or ranks, one indicated by 1 and the other by 2, with the products in each array (1 and 2 respectively) folded into a generally W-shaped configuration, with the characteristics described more clearly below, in such a way that their concave parts face the concave parts of the products of the other array (2 or 1 respectively).

In the illustrated embodiment, which is of this type, each product in one array is interlaced, concatenated or interfolded—in other words, interleaved—with at least one product in the other array.

One purpose of the reference to (at least) one product of the other array is to indicate the fact that each of the products located in the body of the stack P is actually interleaved with two products in the other array, while each of the products located at the ends (at the top and the bottom) of the stack P, as shown in FIGS. 1 and 2, is actually interleaved, in a way independent of the array to which it belongs, with only one of the products in the other array. Each of the aforesaid end products has a branch or flap which faces the exterior of the stack P and is free, in other words not interleaved with other products. This flap can be gripped, as described more clearly below, to enable the corresponding product to be withdrawn from the stack.

In this connection it should also be pointed out that any number of products 1, 2 can be included in the stack P. Furthermore, it should be borne in mind that this number is designed to be reduced gradually in time as the products 1, 2 are withdrawn from the stack P to be used. The fact that FIGS. 1 and 2 show five products in each array, and therefore a total of ten products, is due to evident reasons of simplicity of illustration.

As can be seen clearly in the drawings, each product 1, 2 is folded according to a generally W-shaped profile (preferably symmetrical, for the reasons which will be explained subsequently), so that it has two outer branches A, B and two inner branches C, D. These branches are indicated for only some of the products 1, 2 shown in FIGS. 1 and 2, in order to avoid unnecessary complication of the graphic representation.

Essentially, the W-shaped (or Σ-shaped, which is equivalent) profile is such that each of the outer branches A, B has a free distal edge and a proximal edge joined to a corresponding inner branch (the inner branch C in the case of the outer branch A, and the inner branch D in the case of the outer branch B). The two inner branches C, D are joined together at their corresponding edges opposite to the corresponding outer branches A, B.

The joins are formed along corresponding folding lines.

The particular fold described can be obtained by initially forming the products 1, 2 as a flat laminar product, for example in the form of a web cut from a reel of larger dimensions, and then by folding the aforesaid web into the desired configuration.

All this is done according to known procedures, preferably using devices which are commonly known as "pleating machines".

Persons skilled in the art will, however, understand that the solution according to the invention can also be used in conjunction with the method of interleaving in successive stages as described in European Patent Application 99830650.0 or with the solution described in EP-A-0 955 260 (but with the exclusion, in the latter case, of any requirement to remove the symmetry of the folding profile of the products located in the outer positions in order to permit the forming of connecting bridges between stacks of successive products described in EP-A-0 955 260).

With reference to the illustration of the characteristics of the branches A to D of the products 1 and 2, it will be noted that the outer branches A, B have an extension (seen in the cross-sectional plane of the stack P) which is at least marginally greater than that of the inner branches C and D.

Thus the outer branches A and B have corresponding distal edges which project at least partially beyond the inner branches C and D.

The interleaving between the products 1, 2 is therefore achieved (by known procedures and by means of known equipment: in this connection, reference may again be made to the European patent applications which have been cited several times previously) with the use of only the aforesaid distal edges of the outer branches A and B.

Thus, in the cross-sectional plane of the stack P, it is possible to distinguish three regions, indicated by P1, P2 and P3 respectively (see FIG. 1).

The regions P1 and P3 correspond in practice to the "outer" regions of the stack P. Here, the vertical extension of the stack P is produced, on each side, by the overlapping or stacking of:

- the inner branches C and D of the products of one array (1) and the other array (2) respectively of products 1, 2, and
- the regions of the outer branches A, B of the products of a single array (1 or 2) which are coextensive with the corresponding inner branches C, D.

In the central portion of the stack P, indicated by P2, the vertical extension is formed exclusively by the overlapping of distal edges used for the interleaving of the outer branches A, B of the products of both arrays 1 and 2.

It will be realized, therefore, that the stack P has a completely uniform thickness in all three of the portions P1, P2, P3. This is so because, in the central portion P2, the fraction of the thickness of each product 1, 2 represented by the outer portions P1 and P3 of two inner branches C and D may be considered to be "replaced" by two distal edges of two outer branches B and A of two other products in the other array.

Thus the possible occurrence of undesired phenomena of "rising", with consequent deformation of the stack P, is prevented.

In the lower central part of FIG. 1 only, broken lines indicate schematically the fact that, by acting (in a known way) on the equipment which shapes each individual product, it is possible to vary selectively the dimensions relative to the distal edges of the outer branches A, B which project beyond the inner branches C, D.

This makes it possible to vary selectively the extension of the distal edges of the branches A, B used for the purposes of interleaving, in such a way that it is possible to modify the surface extension of the portions of product which are interfolded or interlaced in order to achieve the interleaving. By varying this surface extension it is possible to adjust in a selective way (and with high precision) the pulling mechanism that can be established between successive products in the interleaving system. Thus it is possible to prevent this mechanism from being too weak (with the risk that the withdrawal of a product from the stack does not prepare the next product for withdrawal) or too strong (with the risk that the withdrawal of a product causes, in an undesired way, at least a partial withdrawal of the next product). In particular, this adjustment of the interaction relationship between successive products can be carried out according to specific characteristics of the products and therefore, for example, according to the characteristics of the material from which the products are made, the presence of any substances acting as pre-moistening agents, the characteristics of these substances, and the shape of the products (in this connection, reference should again be made to the example of the disposable gloves cited above).

The representation in broken lines in FIG. 1 shows that the aforesaid mechanism of varying the relative lengths of the outer branches A, B and inner branches C, D can be applied without modifying the overall width of the stack P, indicated by W in FIG. 1: this is because the elongation of the outer branches A, B is compensated by the shortening of the inner branches C, D.

It will also be understood that the exposure of the products to the exterior is actually limited to the portion of the outer branch A of the product which is located at the end of the stack P exposed to the withdrawal slot or hole S provided (also in a known way, in this case) in the containing enclosure Y which normally houses the stack P. This enclosure Y can be made, according to known procedures, from a laminar material such as card, plastic material, or laminated plastic material. The stack P can also be inserted in a container in the form of a receptacle of thermoformed plastic material provided with a cover which can be opened selectively to give access to the products.

The stack P can advantageously be packaged in a container provided with a closing device having the characteristics described in European Patent Application 99830627.8.

A comparison of FIGS. 1 and 2 also clearly shows that the mechanism for the successive withdrawal of the products from the stack P can use not only the interaction (in the form of frictional pulling) of the distal edges of interlaced outer branches of successive products, but also the mechanical raising action shown schematically in FIG. 2. Here it can be seen that the distal edge of the outer branch B of a product 1 withdrawn previously from the stack P also causes an upward displacement of the distal edge of the branch A of the next product 2, acting as the pick-up flap of the product in question. All of this is done with the consequent presentation of this further distal edge through the pick-up aperture S provided in the package Y. It will also be understood that the solution according to the invention always ensures the desired central positioning of the aforesaid pick-up flap.

FIGS. 1 and 2 will also make it clear that the stack P has characteristics of full symmetry, in the sense that the stack P shown in these figures can be turned over through 180°, in such a way as to bring the end shown in the upper position into the lower position, and vice versa, without modification of the mode of use, or in particular the procedure for withdrawing the products 1, 2.

This characteristic provides advantages both in terms of the forming process (since there is no preferred direction of stacking of the products, the stack P can be fed towards the packaging stations without having to be orientated in a predetermined direction), and in terms of use. This is because it is possible to pick up the products 1, 2 in a wholly identical way from one or the other end of the stack P, and to provide, in addition to the pick-up aperture or hole S shown in the upper part of FIG. 2, another similar aperture, indicated schematically by S', located at the other end of the stack P.

This solution can be applied, for example, to group into a single stack P two packs of products 1 intended to be picked up, respectively, from one and the other of the pick-up apertures provided in the package. For example, each of the two packs of products in question can consist of two corresponding arrays 1 and 2 of products having different characteristics (for example, a pack of "dry" products and a pack of pre-moistened products) which make it necessary to interleave them according to different procedures (in other words, with the distal edges of the outer branches A and B projecting beyond the inner branches C and D by different amounts in one and the other pack).

As stated above, the solution according to the invention makes it possible to achieve this result easily without modification of the width W, which is thus identical for both of the packs in question and is uniform for the whole stack.

Naturally, provided that the principle of the invention is maintained, the details of forming and the embodiments of the invention can be varied widely from what has been described and illustrated, without departure from the scope of the invention as defined in the attached claims.

What is claimed is:

1. A stack of interleaved laminar products comprising a first and a second array of products, each of which has at least one branch interleaved with a corresponding branch of at least one product in the other array, wherein the said products are folded into a generally W-shaped profile comprising two outer branches and two inner branches, with distal edges of the said outer branches projecting at least partially beyond the said inner branches, the said distal edges being capable of being interleaved with at least one other product in the stack.

2. The stack according to claim 1, wherein the said W-shaped profile is essentially symmetrical.

3. The stack according to claim 1, wherein each of the products in the said first and said second array, with the exception of the products located at ends of the stack, has:

a first outer branch having a distal edge interleaved with a distal edge of an outer branch of a first product in the other array, and a second outer branch having a distal edge interleaved with a distal edge of an outer branch of a second product in the other array.

4. The stack according to claim 1, comprising, in cross section:

two outer portions, in which the thickness of the stack is produced by the overlapping of the inner branches of the products in the said first and the said second array respectively with the regions of the outer branches of the products in a same array overlapping the homologous inner branches, and a central portion, in which the thickness of the stack is produced by the overlapping of the interleaved distal edges of the outer branches of the products in both the said first and second array.

5. The stack according to claim 1, wherein extension of the distal edges of the said outer branches with respect to the said inner branches is determined selectively according to at least one of the parameters chosen from the group consisting of:

the material from which the products are made;

the presence of an agent for pre-moistening the products;

the characteristics of the said pre-moistening agent; and the shape of the products, in such a way that the withdrawal of a product from the stack causes another product to be prepared for withdrawal from the stack.

6. The stack according to claim 1, wherein the said products comprise disposable hygiene or cleansing products.

7. The stack according to claim 6, wherein the disposable or cleansing products comprise handkerchiefs, napkins, sheets of toilet paper, or laminar articles.

8. The stack according to claim 7, wherein the laminar articles comprise gloves.

9. The stack according to claim 1, having a profile with a symmetrical cross section, with the consequent possibility of withdrawing the products equally effectively from one or the other end of the stack.

10. The stack according to claim 1, comprising a first and second pack of products with different characteristics, which can be taken, respectively, from one and the other end of the stack.

11. The stack according to claim 10, wherein the distal edges of the said outer branches project beyond the corresponding inner branches by different amounts in the products of the said first and the said second pack respectively.

12. The stack according to claim 1, wherein at least one of the products located at an end position in the stack has an outer branch forming a pick-up flap located in a central position.

13. A package of interleaved laminar products, comprising:

a stack of interleaved laminar products comprising a first and a second array of products, each of said first array and said second array having at least one branch interleaved with a corresponding branch of at least one product in the other array, wherein the said products are folded into a generally W-shaped profile comprising two outer branches and two inner branches, with the distal edges of the said outer branches projecting at least partially beyond the said inner branches, the said distal edges being capable of being interleaved with at least one other product in the stack, and an enclosure which surrounds the said stack with the provision of at least one aperture for the withdrawal of the products from the stack.

14. The package according to claim 13, wherein, in the said enclosure, there are provided a first and a second aperture for the withdrawal of the products from the stack, said first and second apertures being located at a first end and a second end of the stack respectively.

15. A process for forming a stack of interleaved laminar products, comprising a first and a second array of products, each of said first array and said second array having at least one branch interleaved with a corresponding branch of at least one product of the other array, the process comprising the operations of:

folding the said products into a generally W-shaped profile, comprising two outer branches and two inner branches, with distal edges of the said outer branches at least, partially projecting beyond the said inner branches, and using in each product at least one of the said distal edges for interleaving with at least one distal edge of another product in the stack.

16. The process according to claim 15, comprising the said W-shaped profile is essentially symmetrical.

17. The process according to claim 15, comprising the operation of interleaving the products in the said first and said second arrays, with the exception of the products located at the ends of the stack, so that each of the said products has:

a first outer branch having a distal edge interleaved with a distal edge of an outer branch of a first product in the other array, and a second outer branch having a distal edge interleaved with a distal edge of an outer branch of a second product in the other array.

18. The process according to claim 15, comprising the operation of defining within the said stack, seen in cross section, two outer portions, in which the thickness of the stack is produced by the overlapping of the inner branches of the products in the said first and the said second array respectively, and the regions of the outer branches of the products in the same array overlapping the homologous inner branches, and a central portion, in which the thickness of the stack is produced by the overlapping of the interleaved distal edges of the outer branches of the products in both the said first and second array.

19. The process according to claim 15, comprising the operation of selectively determining the extension of the distal edges of the said outer branches beyond the said inner branches according to at least one of the parameters chosen from the group consisting of:

the material from which the products are made;

the presence of an agent for pre-moistening the products;

the characteristics of the said pre-moistening agent; and the shape of the products, the said operation being conducted in such a way that the withdrawal of a product from the stack causes another product to be prepared for withdrawal from the stack.

20. The process according to claim 15, wherein the said products comprise disposable hygiene or cleansing products.

21. The process according to claim 20, wherein the disposable or cleansing products comprise handkerchiefs, napkins, sheets of toilet paper, or laminar articles.

22. The process according to claim 21, wherein the laminar articles comprise gloves.

23. The process according to claim 15, comprising the operation of forming the said stack with a profile having a symmetrical cross section, with the consequent possibility of withdrawing the products equally effectively from one or the other end of the stack.

24. The process according to claim 15, comprising the operation of forming the said stack as an assembly of a first and a second pack of products with different characteristics, capable of being picked up, respectively, from one and the other end of the stack.

25. The process according to claim 24, wherein the products included in the said first and the said second pack are folded with the distal edges of the outer branches projecting beyond the corresponding inner branches by different amounts in the products of the first and second pack, respectively.

* * * * *